US009105270B2

(12) United States Patent
Pandya

(10) Patent No.: US 9,105,270 B2
(45) Date of Patent: Aug. 11, 2015

(54) METHOD AND APPARATUS FOR AUDIO SIGNAL ENHANCEMENT IN REVERBERANT ENVIRONMENT

(71) Applicant: Bhoomek D. Pandya, Taipei (TW)

(72) Inventor: Bhoomek D. Pandya, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 255 days.

(21) Appl. No.: 13/762,368

(22) Filed: Feb. 8, 2013

(65) Prior Publication Data

US 2014/0229168 A1 Aug. 14, 2014

(51) Int. Cl.

| | |
|---|---|
| ***G10L 21/0264*** | (2013.01) |
| *G10L 21/0216* | (2013.01) |
| *G10L 21/0208* | (2013.01) |

(52) U.S. Cl.

CPC ... *G10L 21/0264* (2013.01); *G10L 2021/02082* (2013.01); *G10L 2021/02166* (2013.01)

(58) Field of Classification Search

None

See application file for complete search history.

(56) References Cited

U.S. PATENT DOCUMENTS

| | | | | |
|---|---|---|---|---|
| 4,817,157 | A * | 3/1989 | Gerson | 704/230 |
| 4,847,906 | A * | 7/1989 | Ackenhusen | 704/217 |
| 5,673,361 | A * | 9/1997 | Ireton | 704/219 |
| 7,508,948 | B2 | 3/2009 | Klein et al. | |
| 2006/0039458 | A1 * | 2/2006 | Ding | 375/232 |

FOREIGN PATENT DOCUMENTS

| | | |
|---|---|---|
| TW | I356398 | 1/2012 |

OTHER PUBLICATIONS

Makhoul, "Linear prediction: A tutorial review", Proceedings of the IEEE, Apr. 1975, vol. 63, p. 561-p. 580.

Gillespie et al., "Speech Dereverberation Via Maximum-Kurtosis Subband Adaptive Filtering", 2001 IEEE International Conference on Acoustics, Speech, and Signal Processing, Jun. 2001, p. 1-p. 4.

Kumar et al., "Gammatone Sub-Band Magnitude-Domain Dereverberation for ASR", 2011 IEEE International Conference on Acoustics, Speech and Signal Processing, May 2011, p. 1-p. 4.

* cited by examiner

*Primary Examiner* — Jeremiah Bryar

(74) *Attorney, Agent, or Firm* — Jianq Chyun IP Office

(57) ABSTRACT

The present disclosure proposes a method and an apparatus to enhance reverberated speech by applying reverberation detection in conjunction with reverberation cancellation. The reverberation detection is based on Kurtosis of cross correlation of LPC residue and outputs the result of the reverberation detection to the reverberation cancelling system. The reverberation cancellation receives the result from the reverberation detection, and the cancellation is based on dual adaptive filtering in LP residue and time domain.

20 Claims, 9 Drawing Sheets

| 1010 database name | 1020 original (no processing) | 1030 Prior Art NMF formulation | 1040 Our improved method | 1050 our improved method + utterance verification from signal |
|---|---|---|---|---|
| database1 | 68 | 81 | 84 | 86 |
| database2 | 72 | 81 | 80 | 88 |
| database3 | 73 | 80 | 88 | 90 |
| database4 | 88 | 89 | 93.2 | 94 |
| database5 | 55 | 70 | 79 | 86 |
| database6 | 61 | 60 | 65 | 73.5 |

FIG. 8A

METHOD AND APPARATUS FOR AUDIO SIGNAL ENHANCEMENT IN REVERBERANT ENVIRONMENT

BACKGROUND

1. Technical Field

The present disclosure generally relates to a method and an apparatus for audio signal enhancement in a reverberant environment.

2. Related Art

Reverberation is essentially the multi-path problem of the acoustic signal and occurs in a completely or partially enclosed environment in which acoustic waves trapped in the enclosure repeatedly reflect of the surface of the enclosure. When a speech signal is captured by a microphone in a reverberated environment, the speech signal not only contains the direct component of the speech, but may also contain a reverberation component which interferes with the direct component of speech as well as any background noise component from the environment which may be picked up by the microphone. The background component may include white noise, noise of background cooling systems such as cooling fans, clock noise, harmonics of clock noise, and so forth.

While a human ear may be relatively immune to the effects of reverberation, typical automatic speech recognition (ASR) engines would suffer the impact of the reverberation as the ASR accuracy in a reverberated environment could typically drop between twenty to thirty percent. If a person says "I want to play", the current ASR engine may have difficulty recognizing the phrase since the effect of "want" may jump into "to", and the effect of "to" may jump into "play". If the environment is highly reverberated, the effect of "I want to" may all jump into "play". While the background noise may be easy to remove, the reverberation on the other hand may be much more difficult to eliminate as hundreds of multi-path speech signals could be reflected into a microphone when the speech is continuous. Therefore, various endeavors in the field of speech have been made to identify and cancel the effect of reverberation.

One such endeavor is disclosed in a research paper by Bradford W. Gillespie et al. titled "SPEECH DEREVERBERATION VIA MAXIMUM-KURTOSIS SUBBAND ADAPTIVE FILTERING" which is hereby incorporated by reference for all purposes. In this research paper, the microphone signal is processed using a modulated complex lapped transform (MCLT), in which the subband filters are adapted to maximize the kurtosis of the linear prediction (LP) residual of the reconstructed speech. The key concept of this research paper is to control the adaptive subband filters not by a mean-square error criterion, but by kurtosis metric of LP residuals.

Linear prediction (LP) is a mathematical technique from which the future values of a speech signal could be estimated based on a linear function of previous samples. After the process of inverse filtering, and the remaining LP values after the subtraction of the filtered signal referred to as the LP residual or LP residue. The LP residue contains information about the excitation source of speech production. In other words, the LP residue is considered to contain nearly the pure excitation source since it has removed unwanted artifacts of the vocal track. A paper published 1975 by "John Makhoul" titled "LINEAR PREDICTION: A TUTORIAL REVIEW" discloses a technique for modeling and calculating of the LP residual and is hereby incorporated by reference.

In the recent research in the field, the characteristics of kurtosis in LP residual have been utilized for removing reverberation. Kurtosis is a measure of the "peak-ness" of the probability distribution of a real-valued random variable. In a similar way to the concept of "skew-ness", kurtosis characterizes the shape of a probability distribution function (PDF). For example, if the shape of a plotted histogram of a random variation is completely Gaussian, then the random variable would have a kurtosis value equals to zero.

It has been observed that the probability distribution function (PDF) of the LP residual for clean speech components is sub-Gaussian whereas the corresponding PDF for the reverberated components is approximately Gaussian. Thus, the LP residual for the reverberated segments exhibits higher entropy than that of the clean segments. Therefore, one method could be to utilize the aforementioned characteristics of the kurtosis of the LP residual by developing an adaptive algorithm which maximizes the kurtosis of the LP residual. In other words, a blind de-convolution filter could be searched to make the LP residual as far from being Gaussian as possible.

This particular method could be characterized as follows. First, a reverberant speech is inputted into an adaptive inverse filter which is aimed to remove the effect of reverberation. A LP analysis is then performed for the output of the adaptive inverse filter. Next, the gradient of the Kurtosis is calculated based on the output of the LP analysis. The result of the Gradient of Kurtosis is then fed back to the Adaptive Inverse filter to adjust the filter coefficients of the Adaptive Inverse filter accordingly. Essentially, this particular method is based on maximizing the kurtosis of the LP residual of the output speech signal.

Another approach to removing effects of reverberation is presented in a research paper by Kshitiz Kumar titled GAMMATONE SUB-BAND MAGNITUDE-DOMAIN DEREVERBERATION FOR ASR, which is hereby incorporated by references for all purposes. This particular method is based on performing non-negative matrix factorization (NMF) processing on an input speech signal in the GammaTone magnitude spectral domain. For this method, a reverberated speech is assumed to be the convolution of a clean speech and a room response; therefore by factoring the reverberated speech using a least-squares error criterion into a clean speech and a filter by using the non-negatively and the sparsity of the speech as constraints, the room response can be estimated iteratively.

A NMF processing technique in the GammaTone frequency domain could be explained as followed. Assuming that an input speech signal is captured. The input speech signal is first pre-emphasized with a causal filter, and then is windowed. Next, FFT analysis is performed to the windowed signal, and then a GammaTone transformation is performed by applying a GammaTone filter to the FFT signal. A GammaTone filter is a linear filter described by an impulse response that is the product of a gamma distribution and sinusoidal tone and is a widely used model of auditory filters in the auditory system. Next, NMF processing is performed to the signal after GammaTone transformation, and the NMF decomposition is directly applied individually to each of the FFT channels. A pseudo-inverse of the GammaTone filter is then applied to the NMF processed signal to obtain the processed Fourier frequency components, and then the frequency components can be converted back to the time domain to obtain the final output speech signal.

SUMMARY OF THE DISCLOSURE

Accordingly, the present disclosure is directed to a method for enhancing audio signals in a reverberated environment and an apparatus using the same.

The present disclosure directs to a method for enhancing reverberated speech signal, adapted for an electronic device, and the method includes the steps of receiving a first speech signal, calculating the linear prediction (LP) residual of the first signal, applying a first non-negative matrix factorization (NMF) process to the LP residual, copying filter coefficients from the first NMF process, and processing the first signal by applying a second NMF process using the filter coefficients from the first NMF process as the initial condition to produce a second signal.

The present disclosure directs to a method for detecting reverberated speech signal, adapted for an electronic device, and the method includes the steps of receiving the first signal from a first channel and a second channel, obtaining a first LP residual from the first channel and obtaining a second LP residual from the second channel, cross-correlating the first LP residual and the second LP residual to obtain a cross-correlation value, obtaining from the cross-correlation value a kurtosis which represents the reverberation level of the first signal, and converting the kurtosis into the linear scale.

The present disclosure directs to an apparatus for enhancing reverberated speech and contains at least the elements of a transducer and a processor coupled to the transducer, and the processor is configured for receiving a first speech signal, calculating the linear prediction (LP) residual of the first signal, applying a first non-negative matrix factorization (NMF) process to the LP residual, copying filter coefficients from the first NMF process, and processing the first signal by applying a second NMF process using the filter coefficients from the first NMF process as the initial condition to produce a second signal.

In order to make the aforementioned features and advantages of the present invention comprehensible, preferred embodiments accompanied with figures are described in detail below. It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 8A and FIG. 8B illustrates an experimental test result using the method and apparatus of the present disclosure.

DETAILED DESCRIPTION OF DISCLOSED EMBODIMENTS

The problem under consideration is the enhancement of audio signal in a reverberated environment for the purposes such as speech recognition or speaker identification. In speech recognition systems test under a highly reverberant environment, the accuracy of speech recognition could be reduced by almost 20-30% in comparison to the case without the presence of reverberation. In a reverberated environment, an algorithm to improve signal qualities may still yet be needed to increase the accuracy of these applications. To further optimize the algorithm, it is discovered that it is important to judge the presence of reverberation as well as to detect the amount of reverberation in order to tune the algorithm to optimum a response. Also for real time applications of speech recognition, reducing computation time has become a high priority. When the computation for real time applications occur constantly, a good strategy may be needed in order to reduce system resources. Considering these important criteria, a generalized scheme could be proposed to detect reverberation and subsequently to remove the effect of reverberation from captured audio signals.

The idea to further optimize the computational algorithm is to apply an adaptive algorithm like NMF to both the raw input speech signal and to the LPC residue of the input speech signal. The output from adaptation on LP residue is used as a seed for the adaptation on the unprocessed input signal. This dual adaptation leads to an improvement in ASR accuracy and also requires less iteration of adaptations which could lead to lesser musical noise in the output signal. Furthermore, a reverberation detection algorithm is proposed, and the detection algorithm detects whether the input speech signal is affected by reverberation or not. This is a very important detection because we cannot apply reverberation removing adaptation on signal which has no reverberation as this would probably lead to unnecessarily removing some signal artifacts. Failing to detect reverberation can also reduce ASR accuracy. Thus the present disclosure focuses on a method to detect and subsequently remove reverberation effects from input speech signals, and the resulting output signal leads to an improved performance for ASR, speaker identification, and etc.

Figure 1:
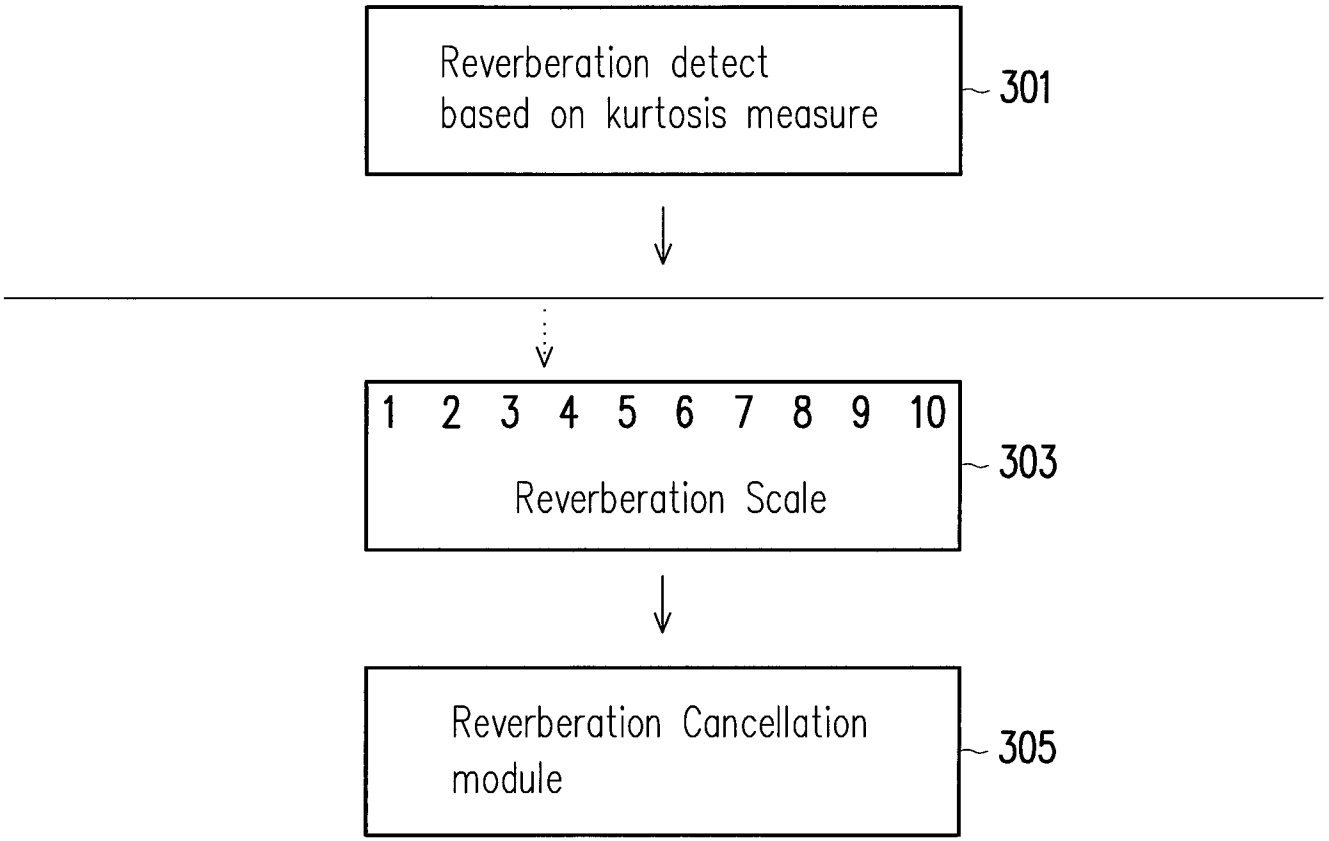
FIG. 1 illustrates a reverberation cancellation system used to enhance the signal quality in accordance with one of the exemplary embodiments of the present disclosure.

FIG. 1 illustrates an overall reverberation cancellation system used to enhance the signal quality in accordance with one of the exemplary embodiments of the present disclosure. The reverberation cancellation system includes a reverberation detector 301 which detects how reverberated a speech signal is, and then the reverberation detector output the detection result in a reverberation scale 303. The scale, for example, could be between 0 to 10 with 0 stands for no reverberation and 10 stands for complete reverberation. The reverberation scale could measure how much data is reverberated or how many frames. For example, for every integer multiple of 1, the reverberation scale could symbolize 1 signal frame which could be about 10 millisecond long. The detection result which is based on a scale between 0 to 10 could then be inputted to the reverberation cancellation module 305 which could then know how reverberated the input speech signal is and can adapt accordingly.

Figure 2:
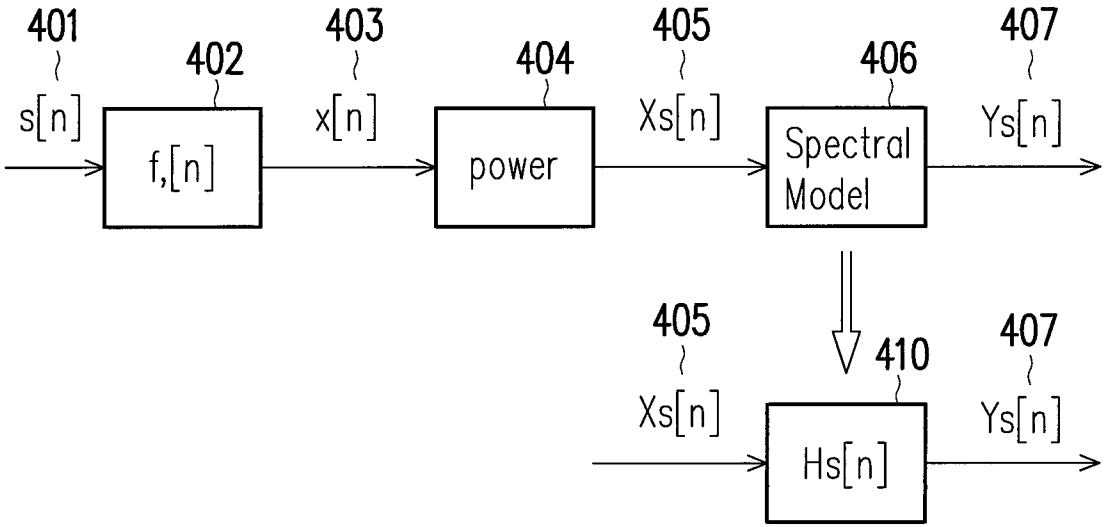
FIG. 2 illustrates a signal model for applying NMF in accordance with one of the exemplary embodiments of the present disclosure.

FIG. 2 illustrates a signal model for the system, particularly the reverberation cancellation module 305 in accordance with one of the exemplary embodiments of the present disclosure. In FIG. 2, s[n] 401 is a digitized input signal and is filtered through a filter f[n] 402. The filter f[n] 402 could be but not limited to a low pass filter which performs a windowing function. The output of the filter f[n] 402 is x[n] 403. The signal x[n] 403 is then transformed into the power domain by the transfer function 404. The transfer function 404 may accomplish the transformation by performing Fourier transform on the signal x[n] 403 and then taking the absolute value or the squared absolute value of the Fourier transform to produce an output value Xs[n] 405 in the power domain. In one of the exemplary embodiments, the transfer function 404 could perform a GammaTone transformation to convert x[n] into a GammaTone power domain signal. In one of the exemplary embodiments, the transfer function 404 could also be a Mel filter. The signal Xs[n] 405 is then processed by a transfer function 406 to produce an output Ys[n] 407 which represented the reverberated speech. The transfer function 406 is the spectral model of the effect of the room which causes the acoustic multipath to the speech signal. One of the main problems to be solved is to estimate the transfer function 406. If the transfer function 406 could be accurately estimated, then the reverberated component of the speech could be cancelled. In accordance with one of the exemplary embodiments of the present disclosure, the transfer function 406 is represented by Hs[n] 410 which could be derived as follows.

First, the reverberated speech Ys[n] 407 could be decomposed into a convolution between Xs[n] 405 and Hs[n] where Xs[n] is the power domain speech component, and Hs[n] 410 is the effect of the room. In other words, Hs[n] 410 is factored out from Ys[n] 407. In this process, only Ys[n] 407 needs to be observed as the process does not require any fore-knowledge of Xs[n] 405 and Hs[n] 410. However, there could be millions of solutions for Hs[n] 410 and therefore some kind of constrain needs to be applied. One constrain which could be used is to assume non negativity since the magnitude of the power spectra could not be negative. Another optional constrain which we have not strictly imposed could be that the sum of Hs[n] 410=1. However, it should be noted that other constrains could be applied by persons skilled in the art so that the present disclosure is not limited to these two constrains.

To solve the problem of decomposition, a process to be used could be a non-negative factorization framework (NMF). In order to perform NMF, one variable needs to be retained which is Z[n] (not shown in FIG. 4), the actual observed output of Hs[n] 410 whereas Ys[n] 407 is the theoretical output which is calculated during the process. Next, the objective is to be minimized the mean square error between the actual observed output Z[n] and the calculated output Ys[n] 407 with a minimization equation. It should be noted that the minimization equation could be implemented and could vary by persons skilled in the art as the presented disclosure is not limited by the specific minimization equation. The minimization for instance could be performed by a gradient descent process which guarantees at least a locally optimal solution using the aforementioned constrains. The update equation of Xs[n] 405 could be derived based on an equation being that the updated Xs[n] 405 for each iteration is the current Xs[n] 405 subtracted by the derivative of the minimization equation with respect to Xs[n] 405 scaled by a learning rate parameter which could be carefully selected to impose non-negatively of the solution. The update equation of Hs[n] 410 for each iteration could also be setup in a similar way. When the theoretical Xs[n] 405 and Hs[n] 410 are calculated, the effect of the room could be modelled and cancelled out from the speech signal. It should be noted that FIG. 4 illustrates the overall signal model, but the process of removing reverberation would begin at the point of processing the LP residue of an input signal.

Figure 3:
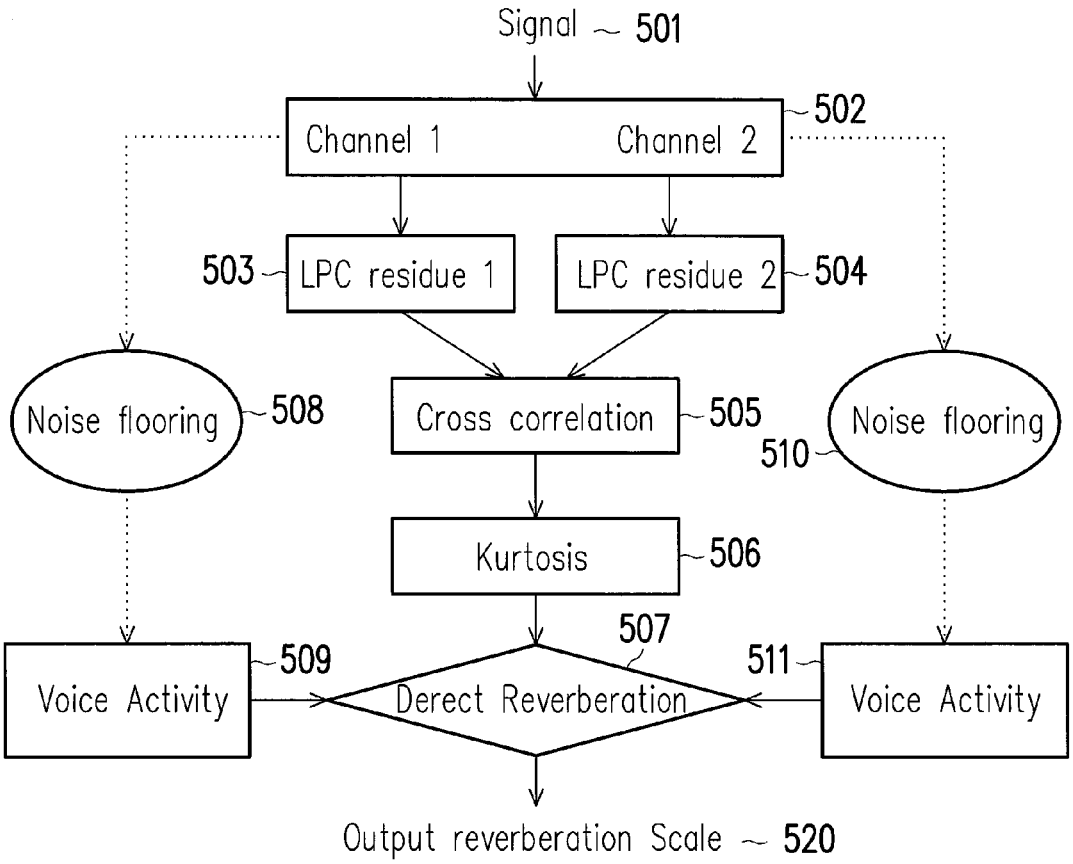
FIG. 3 illustrates a reverberation detection algorithm in accordance with one of the exemplary embodiments of the present disclosure.

FIG. 3 illustrates a reverberation detection algorithm for the reverberation detect 301 portion of the system in accordance with one of the exemplary embodiments of the present disclosure. Referring to FIG. 3, input speech signal 501 is captured by a two channel transducer 502 which converts the acoustic input signal to an electrical signal. The transducer 502 could simply be two different microphones. Next, LPC residue 1 503 and LPC residue 2 504 are calculated from the output of the two channel transducer 502 with one LPC residue for each channel. A cross correlation 505 would then be calculated between LPC residue 1 and LPC residue 2. A kurtosis 506 value could then be calculated from the cross correlation 505 of the two LPC residues. It should be noted that the process of estimating reverberation from kurtosis of LP residue could be somewhat inaccurate and coarse; therefore, obtaining kurtosis 506 of cross correlation 505 of LP residues 503 504 of the two microphones would be preferred. The kurtosis 506 would then indicate the amount of reverberation in the input signal 501 recalling that the probability distribution function (PDF) of LPC residue for clean speech components is sub-Gaussian whereas the corresponding PDF for the reverberated components is approximately Gaussian. Therefore, when there is substantial reverberation present in the input signal 501, the kurtosis value 506 would indicate a Gaussian value. Recalling that a histogram would look exactly like a Bell curve when the Kurtosis is zero. If the histogram is not bell curve, the Kurtosis would either be low or high. If the environment is highly reverberated, the kurtosis would be very flat, or sub-Gaussian. If the input signal 501 does not have any multipath interference, both signals captured by the transducer 502 would be highly correlated and would have a high Kurtosis value. Thus, by this mechanism, the reverberation detect 507 would know the amount of reverberation in the input signal 501 captured by the transducer 502. The reverberation detect 507 could then output the result of the detection in a reverberation scale 303. The reverberation 303 could be a value between 0 and 10 as previously mentioned.

The reverberation detection 507 could be improved by voice activity detection. The Noise flooring 508, 510 is used in voice activity detection. The output of the voice activity detector 509, 511 segments the input speech signal into silence segments and spoken segments. Even though the voice activity detection is non-essential, it could further improve the reverberation detection.

Figure 4:
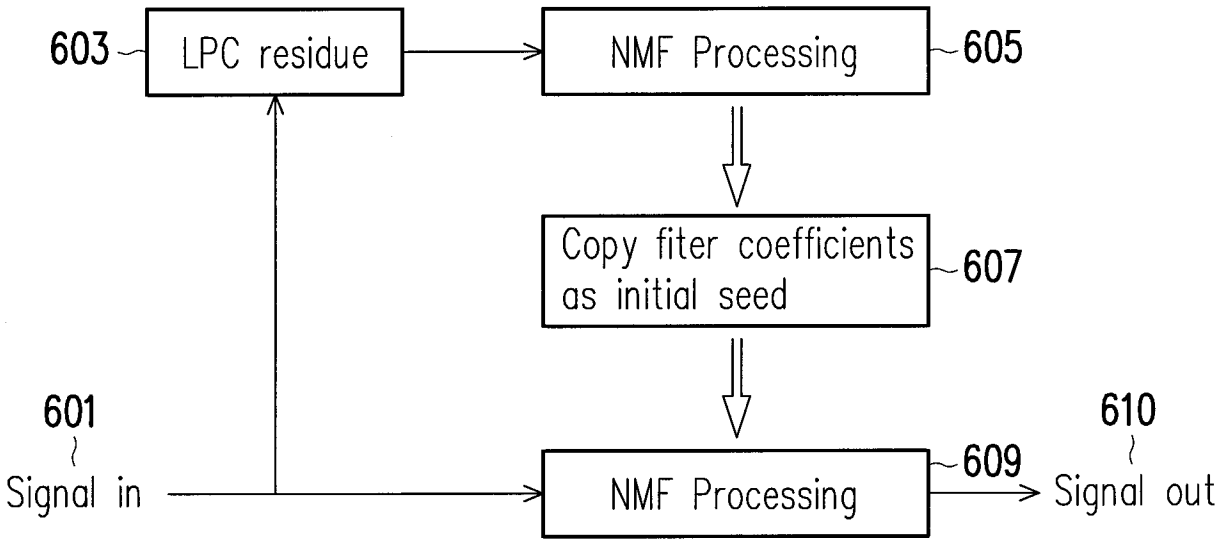
FIG. 4 illustrates reverberation canceling process in accordance with one of the exemplary embodiments of the present disclosure.

FIG. 4 illustrates a reverberation canceling process adapted for the reverberation cancellation module 305 in accordance with one of the exemplary embodiments of the present disclosure. In FIG. 4, the input signal 601 traverses through two paths. In one path, a NMF processing 609 is applied to the input signal 601 to produce an output signal 610. For specific detail related to the NMF process, please refer to the descriptions in the background section and also GAMMATONE SUB-BAND MAGNITUDE-DOMAIN DEREVERBERATION FOR ASR by Kshitiz Kumar. In another path, the LPC residue 603 is derived from the input signal 601, and the NMF processing 605 is applied to the LPC residue 603. The filter coefficients used during the NMF processing 605, or particularly the filter coefficients of Hs[n] used for the NMF processing 605, is copied over in 607 to be used by the NMF processing 609 as the initial seed or the initial condition for the Hs[n] in the NMF processing of 609. But for the embodiment of FIG. 4, a second NMF 605 is performed to the LPC residue 603 of the input signal 601 so that a better initial condition could be derived 607 and copied over to be used by the first NMF processing 609. The computation time reduction can be achieved by fewer NMF iterations. As compared to Kshitiz Kumar, the number of iterations of NMF required could be reduced to less than 40%. As Kshitiz Kumar needs 25 NMF iterations on signal for good performance, about 5 NMF iterations on LP residue would be needed to achieve the same goal. In accordance with the present disclosure, not only computation time could be reduced but a better end result could be obtained.

Figure 5:
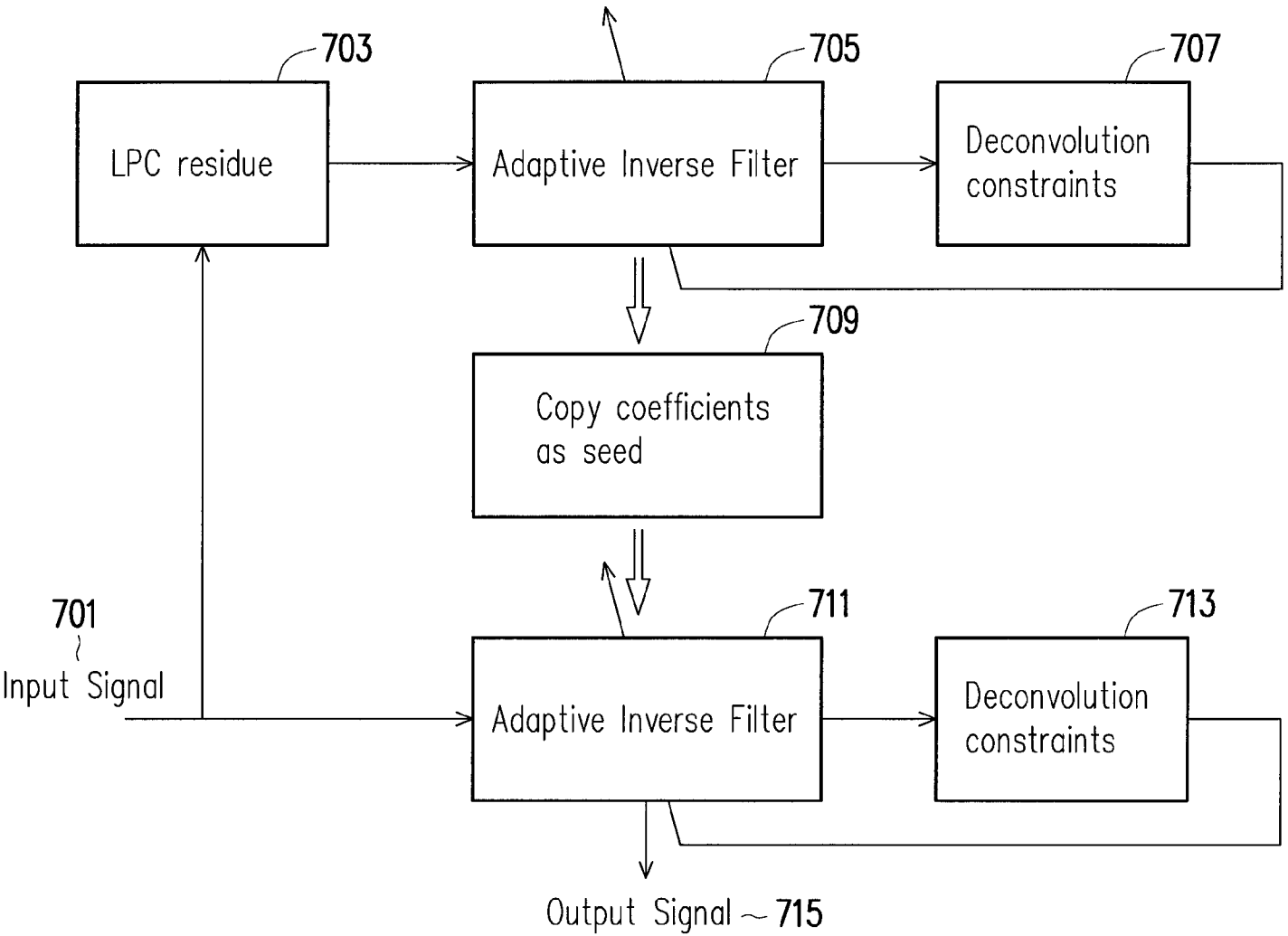
FIG. 5 illustrates a reverberation canceling process in accordance with one of the exemplary embodiments of the present disclosure.

FIG. 5 illustrates a reverberation canceling process in accordance with one of the exemplary embodiments of the present disclosure. FIG. 5 illustrates similar concepts to FIG. 2 and FIG. 4 in more detail. In FIG. 5, the input signal 701 could mirror the signal Xs[n] 405 in FIG. 2. The input signal 701 is processed by the adaptive inverse filter 711 to cancel unwanted portion of a speech, and the unwanted portion may include the effect of reverberation. The adaptive inverse filter 711 is constructed according to the deconvolution constraints 713 adapts to the output of the deconvolution constraints 713 for each iteration to produce the output signal 715. However, a second adaptive inverse filter 705 takes the output of the LPC residue of the input signal 701 and filters out unwanted component of the input speech by applying its own deconvolution constraints 707. The filter coefficients of the adaptive inverse filter 705 is then copied over as an initial seed 709 to the adaptive inverse filter 711 to subsequently enhance the speed of computation and accuracy of the ASR.

Figure 6:
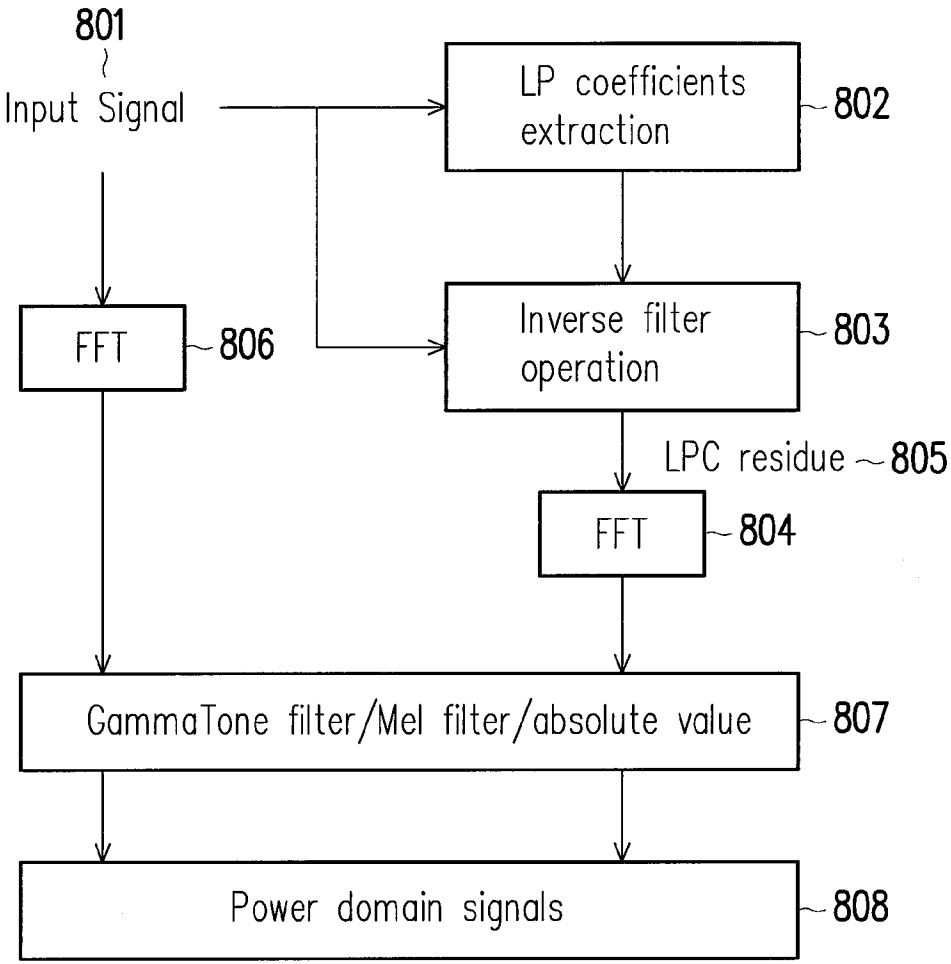
FIG. 6 illustrates the derivation of the power domain signal in accordance with one of the exemplary embodiments of the present disclosure.

FIG. 6 illustrates the derivation of the power domain signal Xs[n] 405 which is part of the reverberation cancelling module 305 in accordance with one of the exemplary embodiments of the present disclosure. In FIG. 6, a digitized input signal 801 is received as an input. The Fast Fourier Transform (FFT) 806 is performed on the input signal 801, and the output of the FFT 806 could be processed in 807 according to one of the GammaTone filter, the Mel filter, or the absolute value could be applied to the output of the FFT. The output of one of these filters in 807 is a power domain signal 808. The input signal 801 is also processed by extracting the LP coefficients 802 of the input signal 801. The LP coefficients 802 and the input signal 801 are used as input to for an inverse filter operation 803 which produces the LPC residue 805 of the input signal 801. In 804, FFT 804 is performed on the LPC residue 805, and then one of the GammaTone filter, Mel filter, or absolute value 807 is applied to the output of the FFT 804 to produce a power domain signal 808.

Figure 7:
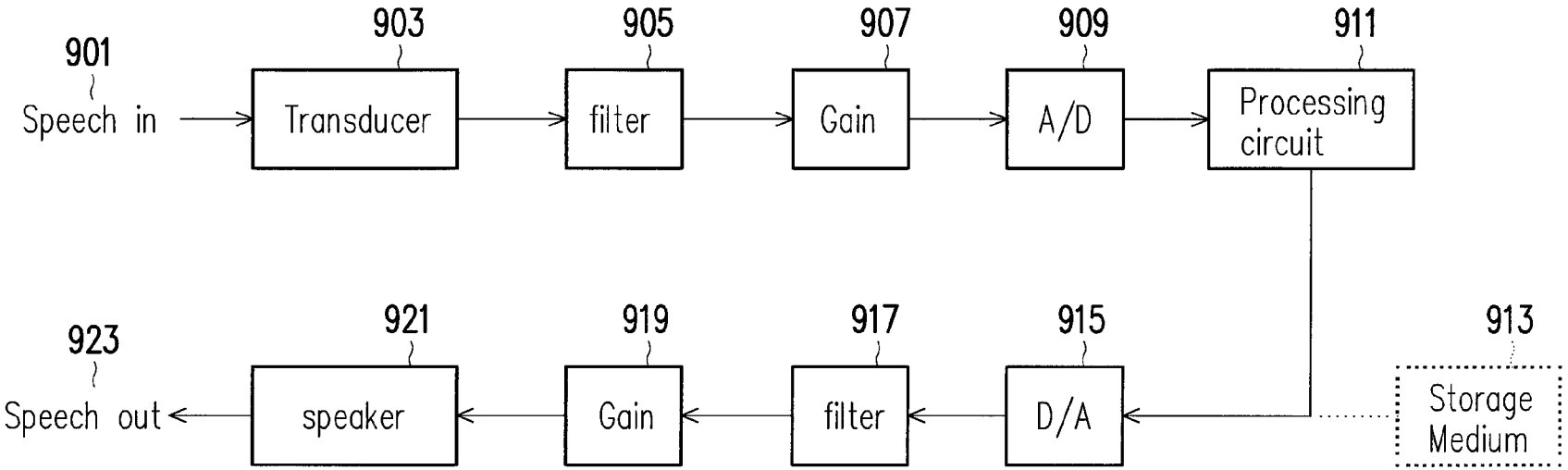
FIG. 7 illustrates a hardware diagram of a reverberation cancellation system in accordance with one of the exemplary embodiments of the present disclosure.

FIG. 7 illustrates a hardware diagram of a reverberation cancellation system in accordance with one of the exemplary embodiments of the present disclosure. In FIG. 7, a speech signal 901 is captured by a transducer 903 and converted to an electrical signal. In 905, a filter could be applied to the electrical signal, and in 907 the output of the filter is amplified by a gain stage. In 909, the amplified signal is digitized into the digital format and be used as an input to a processing circuit 911. The processing circuit may then process the digitalized speech by using the reverberation detection and removal system of 301, 303, and 305 of FIG. 1. It should be noted that the processing circuit 911 may be one or more micro-processors, micro controllers, or several very large integrated circuits (VLSI). The processing circuit may be connected to a storage medium 913 to store temporary buffered data and permanent digitized data. In 915, processed speech having minimized reverberation could be taken from the output of the processing circuit 911 or from the storage medium 913 and be used by a speaker 921 to be heard as speech out 923 by first converting back to an analog signal used D/A 915. The output of the D/A 915 may be applied to a filter 917 and a power amplifier 919, and the output of the amplifier would then be fed into the speak 921 and be converted back to acoustic signal as speech out 923.

Figure 8B:
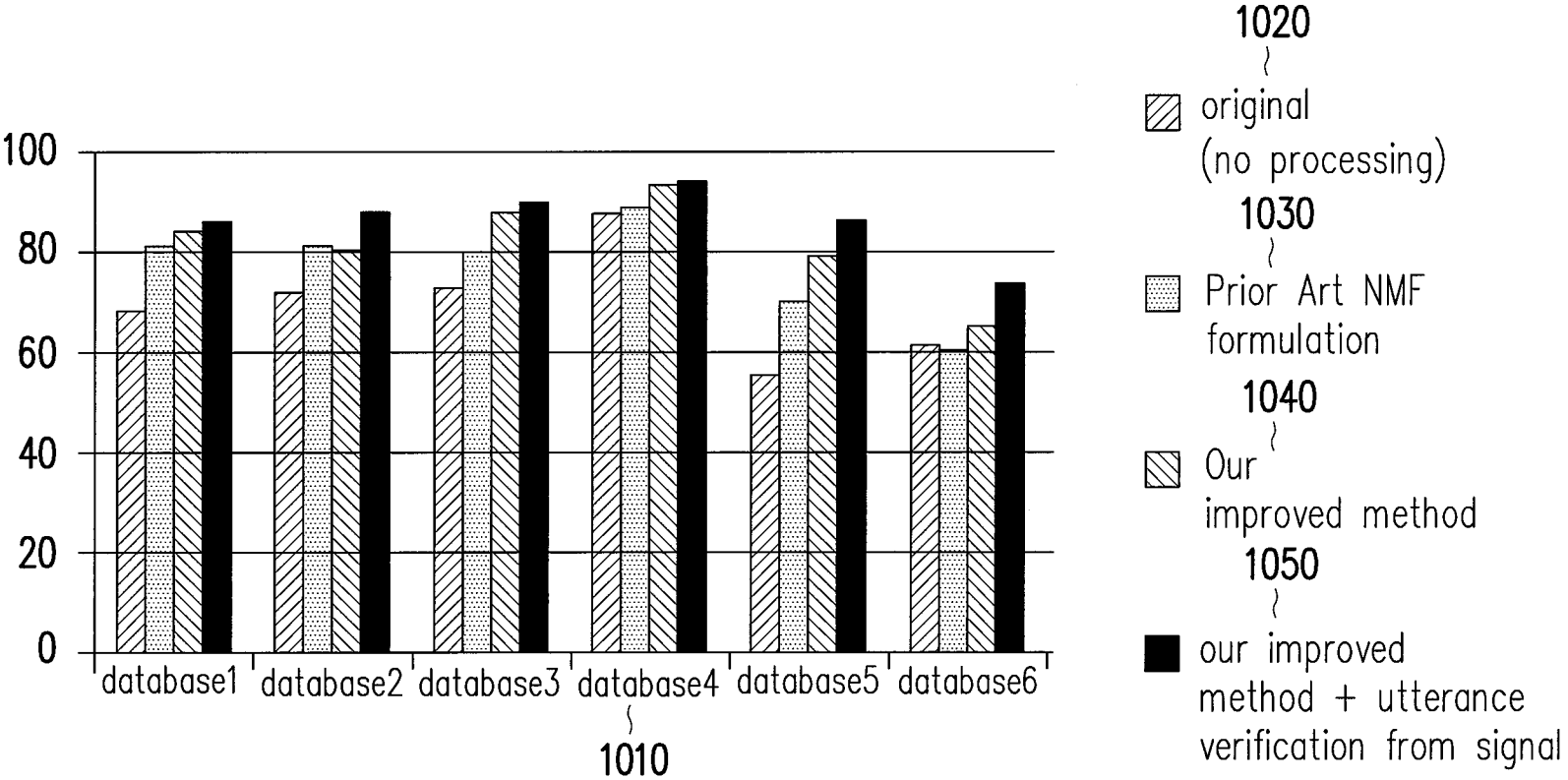

FIG. 8A and FIG. 8B illustrates an experimental test result using the method and apparatus of the present disclosure. In FIG. 8A, the first column 1010 lists 6 databases of various speech data to be tested. The second column 1020 lists the ASR accuracy in terms of percentages for each of the 6 databases. The third column 1030 lists the ASR accuracy for each of the 6 databases by applying the conventional prior art technique (such as Kumar). The fourth column 1040 lists the ASR accuracy using the method and apparatus in accordance with the present disclosure. The fifth column 1050 lists the ASR accuracy using the method and apparatus in accordance with the present disclosure in conjunction with utterance verification from the signal. FIG. 8B illustrates the plot of FIG. 8A by listing a side by side comparison of the second to fifth columns (1020, 1030, 1040, 1050) of FIG. 8A for each of the 6 databases (1010). The vertical axis of the plot lists the ASR accuracy in terms of percentages. Upon visual inspection of FIG. 8A and FIG. 8B, it can be seen that the method and apparatus of the present disclosure nearly out performs the unprocessed speech signal and speech signal using the prior art formulation.

In view of the aforementioned descriptions, the present disclosure is able to enhance reverberated speech by using a reverberation detection and removal system. The reverberation detection is based on Kurtosis of cross correlation of LPC residue and outputs the result of the reverberation detection to the reverberation cancelling system. The reverberation cancelling system receives the reverberation detection result, and the algorithm is based on dual adaptive filtering in LP residue and time domain. By copying the filter coefficients from one adaptive filter to another adaptive filter as an initial condition, the computation time and accuracy could be improved.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A method for enhancing reverberated speech, adapted for an electronic device, and the method comprising:

receiving a first signal;

calculating a linear prediction (LP) residual of the first signal;

applying a first non-negative matrix factorization (NMF) process to the LP residual;

copying filter coefficients from the first NMF process; and processing the first signal by applying a second NMF process using the filter coefficients from the first NMF process as the initial condition to produce a second signal.

2. The method of claim 1, wherein the step of applying the first non-negative matrix factorization (NMF) process to the LP residual comprises:

filtering the LP residual with a first adaptive filter to produce a third signal, wherein the first adaptive filter is obtained by factoring the third signal into the convolution between the LP residual and a first filter component according to a first constrain; and adapting iteratively the first filter component as the first adaptive filter.

3. The method of claim 2, wherein the step of processing the first signal by applying a second NMF process using the filter coefficients from the first NMF process as the initial condition to produce a second signal comprises:

filtering the first signal with a second adaptive filter to produce the second signal, wherein the second adaptive filter is obtained by factoring the second signal into the convolution between the first signal and a second filter component according to a second constrain;

copying the coefficients of the first adaptive filter as the initial condition; and adapting iteratively the second filter component as the second adaptive filter using the initial condition.

4. The method of claim 3, wherein the step of factoring the second signal into the convolution between the first signal and a second filter component according to the second constrain further comprises:

continuously observing the second signal to produced an observed second signal; and factoring the second signal into the convolution between the first signal and a second filter component according to the second constrain by minimizing the mean square error between the observed second signal and the second signal.

5. The method of claim 3, wherein the second constraint comprises non-negativity of the first signal and the second filter component; and a sum of the second filter component equals to 1.

6. The method of claim 1, wherein claim 1 further comprises:

transforming the first signal into a power domain first signal by applying one of a GammaTone filter, a Mel filter, or an absolute value to the first signal.

7. The method of claim 1, wherein the step of receiving a first signal further comprises:

detecting a reverberation level of the first signal and the step of processing the first signal by applying the second NMF process using the filter coefficients from the first NMF process as the initial condition to produce a second signal uses the reverberation level as input.

8. The method of claim 7, wherein the reverberation level is a linear scale in which the minimum of the linear scale represents no reverberation and the maximum of the linear scale represents all reverberation.

9. The method of claim 8, wherein the step of detecting the reverberation level of the first signal further comprises:

receiving the first signal from a first channel and a second channel;

obtaining a first LP residual from the first channel and obtaining a second LP residual from the second channel;

cross-correlating the first LP residual and the second LP residual to obtain a cross-correlation value; and obtaining from the cross-correlation value a kurtosis which represents the reverberation level of the first signal.

10. The method of claim 9 further comprising:

converting the kurtosis into the linear scale.

11. An apparatus for enhancing reverberated speech comprising:

a transducer for converting the reverberated speech into a first signal; and a processor coupled to the transducer and is configured for:

calculating a linear prediction (LP) residual of the first signal;

applying a first non-negative matrix factorization (NMF) process to the LP residual;

copying filter coefficients from the first NMF process; and processing the first signal by applying a second NMF process using the filter coefficients from the first NMF process as the initial condition to produce a second signal.

12. The apparatus of claim 11, wherein the processor is configured for applying the first non-negative matrix factorization (NMF) process to the LP residual comprises:

filtering the LP residual with a first adaptive filter to produce a third signal, wherein the first adaptive filter is obtained by factoring the third signal into the convolution between the LP residual and a first filter component according to a first constrain; and adapting iteratively the first filter component as the first adaptive filter.

13. The apparatus of claim 12, wherein the processor is configured for processing the first signal by applying a second NMF process using the filter coefficients from the first NMF process as the initial condition to produce a second signal comprises:

filtering the first signal with a second adaptive filter to produce the second signal, wherein the second adaptive filter is obtained by factoring the second signal into the convolution between the first signal and a second filter component according to a second constrain;

copying the coefficients of the first adaptive filter as the initial condition; and adapting iteratively the second filter component as the second adaptive filter using the initial condition.

14. The apparatus of claim 13, wherein the processor is configured for factoring the second signal into the convolution between the first signal and a second filter component according to the second constrain further comprises:

continuously observing the second signal to produce an observed second signal; and factoring the second signal into the convolution between the first signal and a second filter component according to the second constrain by minimizing the mean square error between the observed second signal and the second signal.

15. The apparatus of claim 13, wherein the second constraint comprises non-negativity of the first signal and the second filter component; and a sum of the second filter component equals to 1.

16. The apparatus of claim 11, wherein the processor is further configured for:

transforming the first signal into a power domain first signal by applying one of a GammaTone filter, a Mel filter, or an absolute value to the first signal.

17. The apparatus of claim 11, wherein the processor is configured for receiving a first signal further comprises:

detecting a reverberation level of the first signal and the step of processing the first signal by applying the second NMF process using the filter coefficients from the first NMF process as the initial condition to produce a second signal uses the reverberation level as input.

18. The apparatus of claim 17, wherein the reverberation level is a linear scale in which the minimum of the linear scale represents no reverberation and the maximum of the linear scale represents all reverberation.

19. The apparatus of claim 8, wherein the processor is configured for detecting the reverberation level of the first signal further comprises:

receiving the first signal from a first channel and a second channel;

obtaining a first LP residual from the first channel and obtaining a second LP residual from the second channel;

cross-correlating the first LP residual and the second LP residual to obtain a cross-correlation value; and obtaining from the cross-correlation value a kurtosis which represents the reverberation level of the first signal.

20. The apparatus of claim 19 wherein the processor is further configured for:

converting the kurtosis into the linear scale.

* * * * *